US006105622A

United States Patent [19]

Sternheim et al.

[11] Patent Number: 6,105,622

[45] **Date of Patent: *Aug. 22, 2000**

[54] METHOD OF WEFT INSERTION INTO A PLANAR WARP FOR HIGH DENSITY THREE DIMENSIONAL WEAVING

[75] Inventors: Alon Sternheim; Percy Grosberg, both of Ramat Gan, Israel

[73] Assignee: Shenkar College of Textile, Technology and Fashion, Ramat Gan, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 09/033,941

[22] Filed: Mar. 2, 1998

[51] Int. Cl.[7] ..... D03D 41/00

[52] U.S. Cl. ..... 139/11; 139/DIG. 1

[58] Field of Search ..... 139/1 A, 11, 18, 139/24, 26, 27, 96, 188 R, 189, 192, DIG. 1, 1 PC; D03D 41/00

[56] References Cited

U.S. PATENT DOCUMENTS 4,679,784 7/1987 Porat et al. ..... 271/18.3

5,449,025 9/1995 Weinberg ..... 139/11

*Primary Examiner*—John J. Calvert

*Assistant Examiner*—Robert H. Muromoto, Jr.

*Attorney, Agent, or Firm*—Jenkens & Gilchrist

[57] ABSTRACT

The present invention relates to a method for weaving a three dimensional structure by providing a set of planar warp yarns arranged in a plurality of planes, where each plane contains yarns arranged in a decreasing spacing from top to bottom. The plurality of planes are also positioned in a perpendicular direction so that the spacing between adjacent planes decrease from top to bottom, and a weft yarn is inserted between the adjacent planes at a point where the spacing is largest. A moving rod and shaped reed are used to pull and beat the weft yarns into the three dimensional structure situated at a base of the planar warp yarns, where the shaped reed has reed wires arranged in decreasing spacing from top to bottom.

3 Claims, 6 Drawing Sheets

METHOD OF WEFT INSERTION INTO A PLANAR WARP FOR HIGH DENSITY THREE DIMENSIONAL WEAVING

FIELD OF THE INVENTION

The present invention relates to the production of a three dimensional woven structure by the insertion of double picks of yarn alternately in the X and Y direction into a planar warp.

BACKGROUND OF THE INVENTION

A three dimensional structure can be used as the reinforcing skeleton for a composite load bearing structure. The sizes of structures required by industry are such that fairly large weft insertion devices are needed to insert the weft. However, all the yarns must be very closely packed in the final structure to achieve the high strength required for most applications. In U.S. Pat. No. 5,449,025 to Weinberg a method is described whereby warp threads are opened into a shed using a rotating reed to enable the weft to be inserted at the widest opening of the warp. This weft is trapped by closing the warp by rotating the reed back to its original position and the weft is then beaten up into the structure. There are applications where the ratio of the warp spacing required during weft insertion and in the final structure is particularly large, such as between 5 and 10 to one. It is difficult to obtain such a ratio using a rotating reed.

SUMMARY OF THE INVENTION

The present invention relates to a method and system for weaving a three dimensional structure having a predetermined cross sectional shape. The invention, which is especially useful in applications where the ratio of the warp spacing required during weft insertion and in the final structure is particularly large, such as between 5 and 10 to one, does not utilize a rotating reed. Rather the method of the invention comprises the steps of:

providing a set of planar warp yarns, each planar warp yarn containing yarns arranged in a decreasing spacing from top to bottom;

said planar warp yarns being positioned in a perpendicular direction so that the spacing between adjacent planar warp yarns decreases from top to bottom;

inserting a parallel weft yarn through said planar warp yarns at a point where the spacing is largest;

beating weft yarns into the structure by using a moving rod and a shaped reed said reeds having reed wires arranged in a decreasing spacing from top to bottom to pull the weft threads into the dense structure situated at the base of the yarns.

The system of the invention comprises:

a top perforated board for receiving planar yarns threaded therethrough;

a bottom board consisting of two crossed reeds, the density of these reeds being determined by the required density of the structure, the two reeds being separable for threading;

four shaped reeds enclosing the working section of the warp, each reed having a gauge equal to that of the perforated board at the top, and the crossed reed at the bottom;

four moving rods for first reducing the density of the weft sheet by moving it against the shaped reed and then for finally compressing it against the three dimensional woven structure fell.

BRIEF DESCRIPTION OF THE FIGURES

The invention is illustrated by way of example with reference to the enclosed schematic drawings, which are not according to scale and in which.

DETAILED DESCRIPTION OF THE INVENTION

Figure 1A:
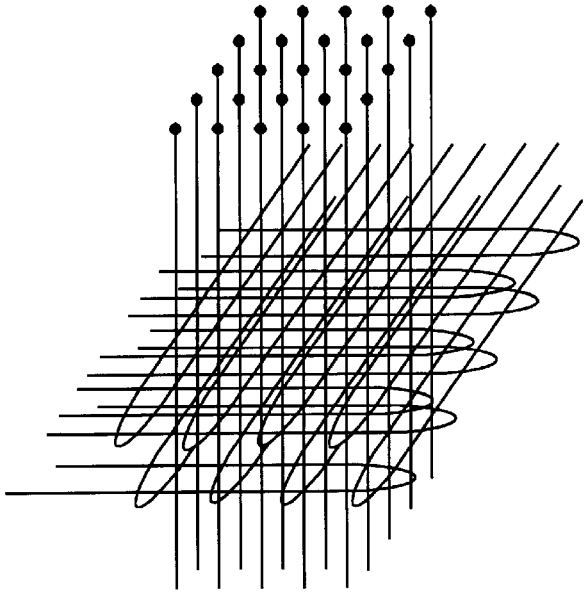
FIG. 1A is a general view of a prior art 3D woven structure.
Figure 1B:
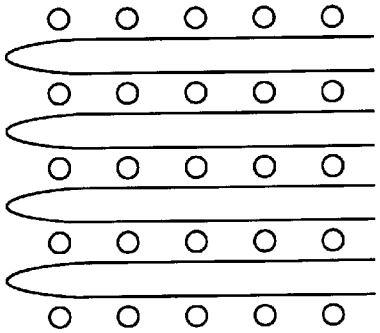
FIG. 1B illustrates a prior art weft insertion in the X direction.
Figure 1C:
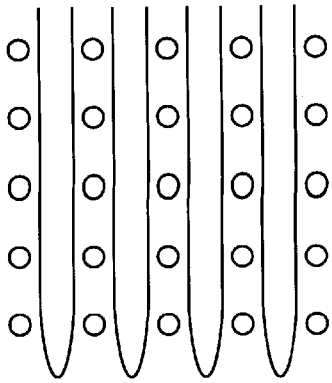
FIG. 1C illustrates a prior art weft insertion in the Y direction.
Figure 2A:
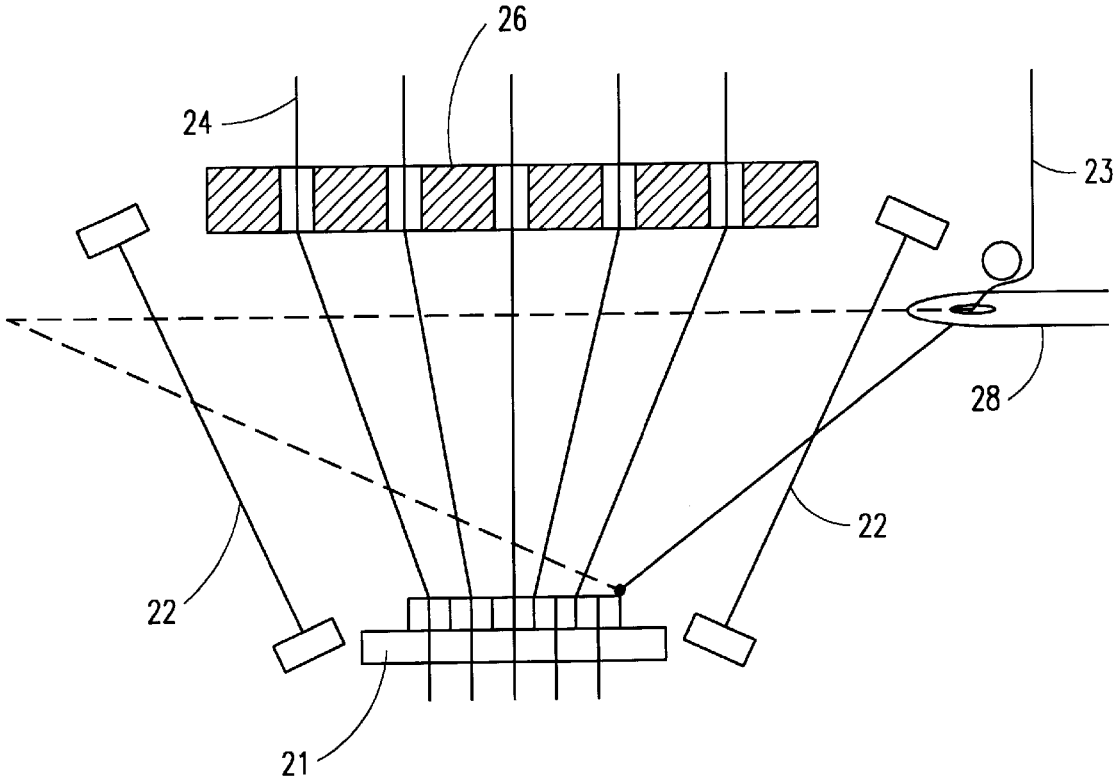
FIG. 2A is a sectional view of the working zone of the warp, in accordance with an embodiment of the invention.

FIGS. 1A–C schematically show a 3D woven structure in which a weft is inserted in X direction in the 3D structure (FIG. 1B) and in Y direction (FIG. 1C). FIG. 2A is a side view of the working part of the warp according to an embodiment of the invention together with two of the four shaped reeds which surround the warp. These shaped reeds 22 are structures consisting of reeds shaped as shown in front view in FIG. 2C and placed round the warp 24 as shown in FIG. 2A. The actual geometry can be varied depending on the application but several features need to be fixed. The warp 24 enters the working section through a perforated board 26 so that usually only one thread passes through each hole 26' (FIG. 2B) and the gauge of the holes depends on the size of the weft insertion mechanism. The warp 24 leaves the working section through a pair of crossed reeds 21 and 21' (as shown in FIG. 2D), the spacing of these reed wires being determined by the required spacing of the threads in the final woven structure. A perforated board is not used at the exit from the working warp section due to the great difficulty found in threading approximately one thousand threads through a series of the same number of fine holes. The distance between the perforated board 26 and the crossed reeds 21 and 21' should be at least as great as the size of the perforated board. The crossed reeds are only needed initially to thread the warp 24. After take down of the completed structure, as described later, the crossed reeds 21 and 21' are taken down ahead of the structure and can be removed if desired.

Figure 2B:
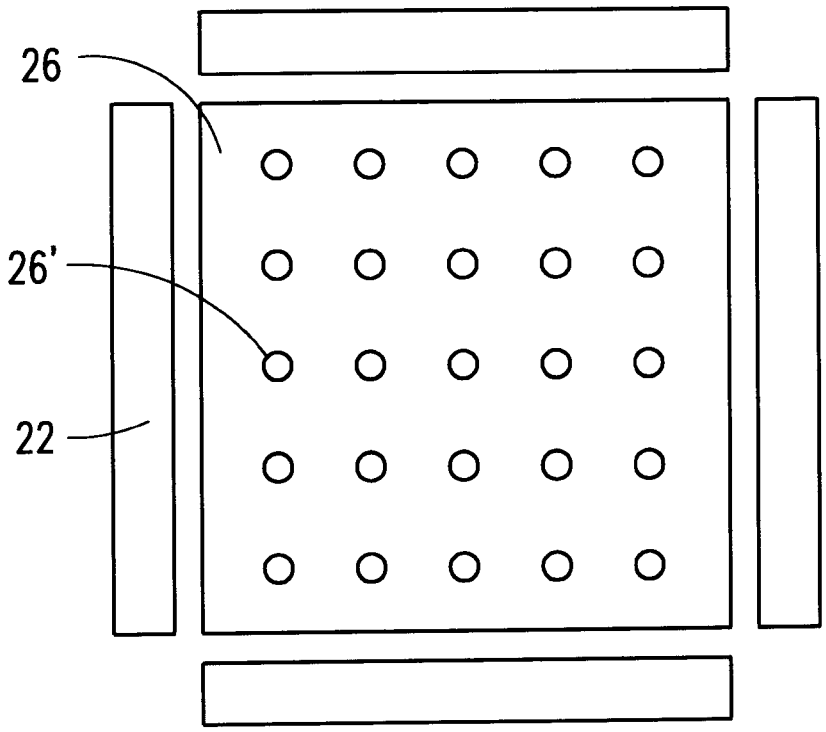
FIG. 2B is a plan of perforated board and four shaped reeds.
Figure 2C:
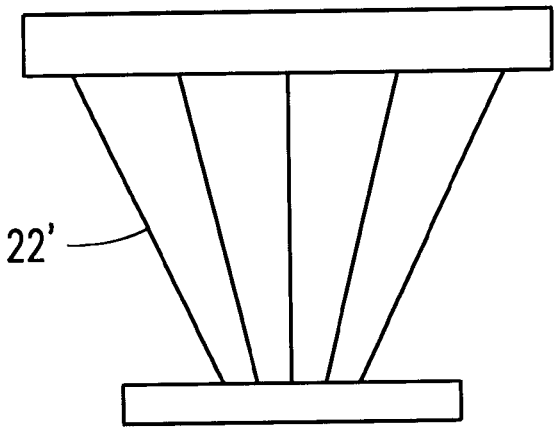
FIG. 2C is a front view of a shaped reed.
Figure 2D:
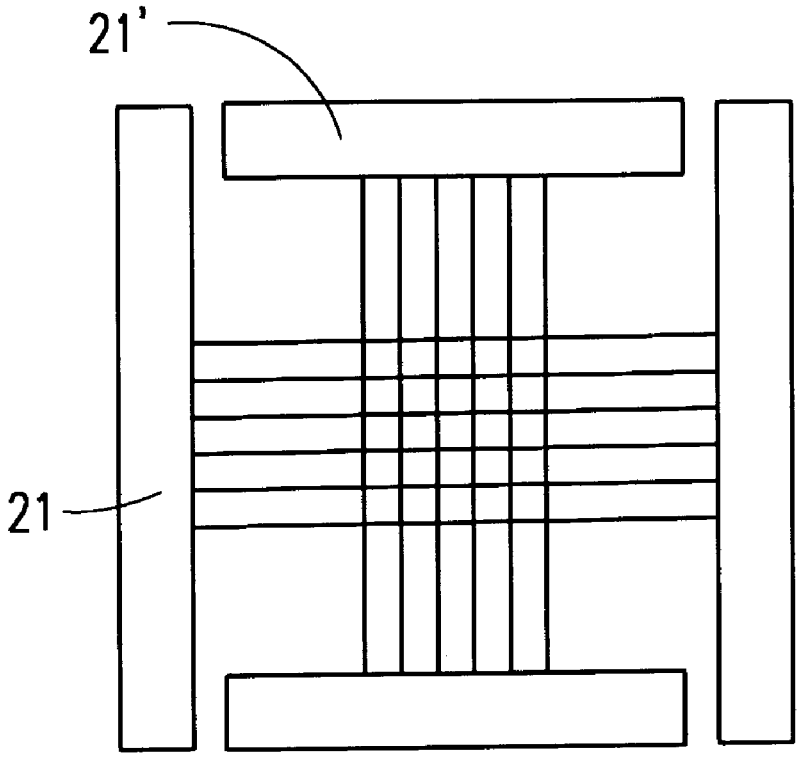
FIG. 2D illustrates two crossed reeds.

The perforated board 26 in FIG. 2B will produce a structure with a square cross section by changing the hole pattern of the perforated board any required cross-sectional shape made up of mutually perpendicular straight lines can be produced.

The four shaped reeds 22 shown in FIG. 2B have a large gauge spacing identical with that of the perforated board 26 at the top and small gauge spacing identical with that of the crossed reeds at the bottom. As a result the reed wires 22' (FIG. 2C) in the left and right shaped reeds are in exact registration with the rows of warp 24 threads and similarly the front and back reed wires are in registration with the columns of warp 24 threads.

As a result the finger 28, one of many, carrying the weft sheet and shown on the right of FIG. 2A, can carry the weft through the right hand shaped reed 22, the warp columns and the left hand shaped reed 22, to produce a typical weft thread 23 shown dotted in FIG. 2A. There are of course many of these fingers, one passing between each column of warp threads.

Figure 3:
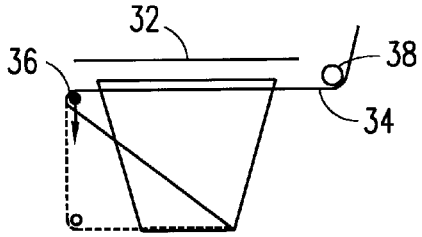
FIG. 3 illustrates a beat-up stage 1.
Figure 4:
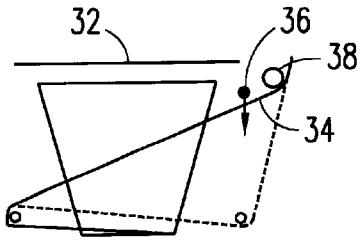
FIG. 4 illustrates a beat-up stage 2.

The method of the invention is demonstrated in FIG. 3 and FIG. 4. By inserting a rod 36 into the triangular section of weft sheet 34 (protruding beyond the shaped reed 32, see FIG. 2A) and lowering this rod 36, the weft yarn is beaten up into the structure to be formed above the crossed reeds as shown in FIG. 3. Following the beat-up (first stage) described in FIG. 3 the finger 28 (shown in FIG. 2A) is moved to its original position resulting in the shape of the weft sheet shown in FIG. 4. A rod, shown cross hatched 36', is inserted as shown above the weft sheet and then brought down to complete the insertion of the double pick.

According to the process described above, a double pick is inserted in the X direction, shown in FIG. 1B. To insert the double pick shown in FIG. 1C a second set of fingers carries a second weft sheet through the rows of these warps and these picks beaten up by a second set of rods as described in the previous paragraph. The four rods, two for the X and two for the Y direction will be defined as the "moving rods" in the description given below.

Determination of Pick Spacing

Figure 5:
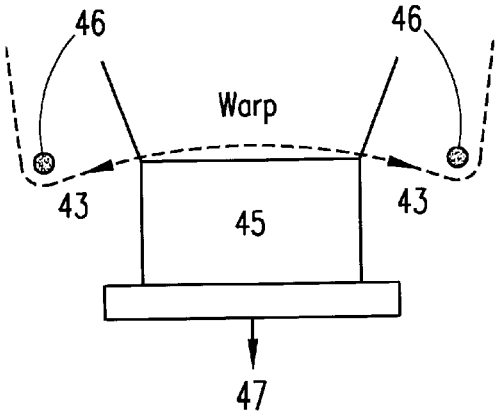
FIG. 5 illustrates the movement of the rods to a lower position.

To insert the pick correctly the thread spacing must be reduced from that at the perforated board to that at the crossed reeds. This is accomplished by the effect of the weft tension which is acting against the sides of the shaped reed wires and pulls the weft threads into position. The pick must also be pressed into position against the crossed reeds and later on, as weaving proceeds, against the previously made structure. This is accomplished by the rods 46 moving to a point below the crossed reeds and subsequently below the position of the previously made woven structure 45 as shown in FIG. 5. As a result the weft tension as shown by arrows 43 press the pick against the previously formed woven structure.

The take down mechanism moves the woven structure 47 down so that the number of "picks" inserted per cycle is as required by the specification of the woven structure 45. The actual position of the free end of the woven structure 45 rises initially during weaving until the weft tension pressure shown by arrows 43 in FIG. 5 is sufficiently large to force the picks into the required density as in conventional weaving.

Selvage Formation

At the completion of a cycle as described above, the moving rods will all be positioned at, or just below, the bottom of the shaped reeds, where they hold down the looped end of double pick. However in the next cycle these moving rods must be removed one at a time from these loops and then moved up to the top of the reed for insertion in the weft sheet as shown in FIG. 3. To prevent these selvage loops from being pulled into the structure, loose rods can be inserted into the loops between the shaped reed 22 and woven structure 45 when the loops are on the point of being formed as shown in FIG. 4. When the moving rod is removed the selvage loops are pulled towards the structure and are held by the loose rod.

After two complete cycles the structure is sufficiently dense to enable the loose rods to be removed without any further movement of the loops into the structure. The loops are usually trimmed off during the embedding of the structure into matrix.

It is possible to eliminate these loops by using a separate weft thread which is wound helically round the structure. It is inserted on the inside of the shaped reed, the stationary rods 35 are removed after only one cycle and the selvage loop then moves through the shaped reed and forms a complete selvage round the structure which incorporates the helical wound weft thread. The preferred method for dealing with the selvage loops depends on the cross-sectional shape of the structure.

Tension Control

The tension of the warp threads is controlled by standard means; the tensioning of the weft, however, requires considerable care.

To clarify the problem let us consider a particular example where the structure is 5 cm square. To make this structure, the shaped reed needs to be 30 cm wide at the top and 50 cm high. The weft insertion mechanism, has to travel some 45 cm. At these dimensions it is found that the weft must be fed a total of 100 cm into the working zone during each half cycle, but some 80 cm of this is returned during the complete cycle. This large feed and take-up is greater than that can be provided by any existing mechanism. The mechanism shown in FIG. 6 was therefore devised.

The weft comes from a series of wound packages (weft beam) 51 each providing one thread for the weft sheet. The feeds from these packages are tensioned by standard means, one of which is illustrated by the diagram. The thread passes over a guide 52 and to a mechanism which consists of a freely rotating pulley 56 attached to a light weight square-sectioned rod 55 (preferably a plastic rod of low specific gravity with low frictional properties). Rod 55 fits into a square bearing so that the rod 55 and pulley 56 can rise and fall with minimum friction but cannot rotate or move in any other direction.

When there is an excess of yarn in the working zone, pulley 56 and rod 55 descend to take up the slack. When yarn is required in the working zone, the rod 55 rises until the yarn from guides 52 to pulley 56 to point 54, lies in a straight line. The yarn tension then rises to a fixed value, while the weft beam 51 provides all the extra yarn needed. This tension is controlled by brake acting on the weft beam packages 51.

Figure 6:
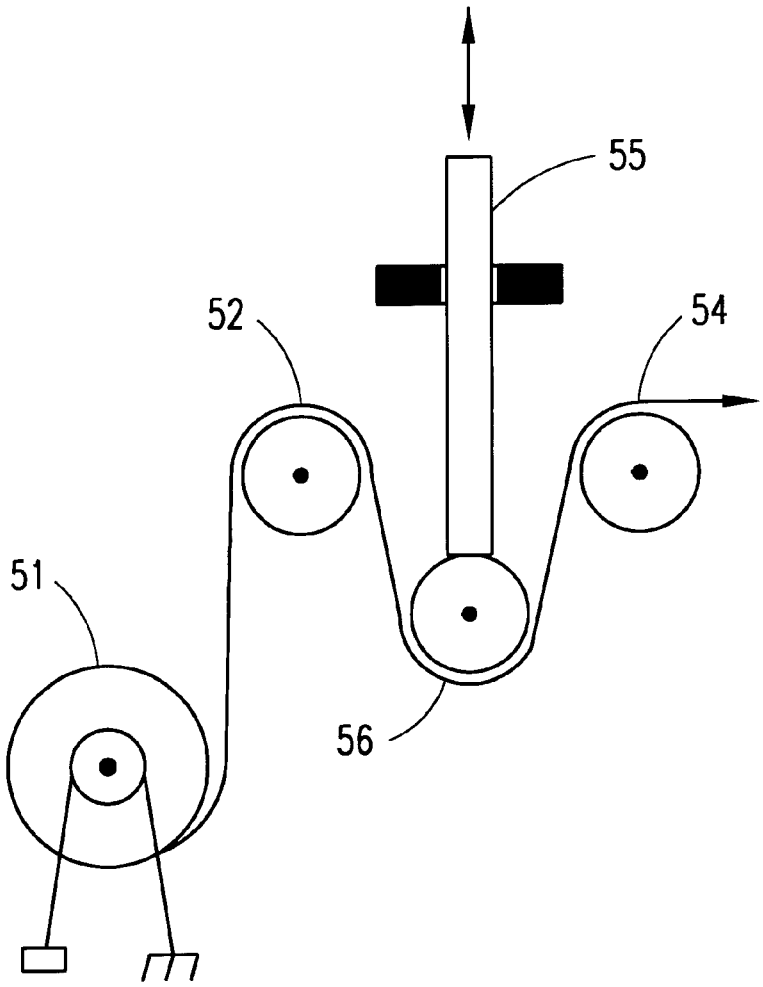
FIG. 6 illustrates a weft thread tensioning and take-up mechanism.

When, however, the yarn passes over the pulleys as shown in FIG. 6, the yarn tension is determined by the weight of the rod 55 in FIG. 6. The tension then should be equal to half the weight of rod 55 and pulley 56. However, due to friction it is found that when yarn is pulled in the working zone its tension rises to about twice this tension and when there is excess yarn which is pulled out of the working zone the tension falls to about half this tension. This large tension change of four to one causes difficulties. To prevent some of these large tension changes it is possible to decrease the flow of yarn into and out of the working zone by synchronizing certain actions to occur at the same time. Thus, the fingers 28 shown in FIG. 2A can start to move back from its extreme position as the moving rod 36 moves down to perform the beat up. Similarly, the withdrawal of the moving rod 36 from the selvage loops shown at the left of FIG. 4 can take place at the same time as the downward action of the moving rod on the right of FIG. 4. By carefully timing the actions the tension variations are greatly reduced.

What is claimed is:

1. A method for weaving a three dimensional structure having a predetermined cross sectional shape, comprising the steps of:

providing a set of planar warp yarns arranged in a plurality of planes, each plane containing a plurality of the planar warp yarns arranged in a decreasing spacing from top to bottom;

the plurality of planes being positioned in a perpendicular direction so that the spacing between adjacent planes decreases from top to bottom;

inserting parallel weft yarns between the adjacent planes at a point where the spacing is largest;

beating the weft yarn into the three dimensional structure by using a moving rod and a shaped reed, said shaped reed having reed wires arranged in a decreasing spacing from top to bottom, to pull the weft yarns into the three dimensional structure situated at a base of the planar warp yarns.

2. The method according to claim 1 further comprising the step of providing various cross-sectional shapes of the planar warp yarns, to form three dimensional fabrics of various cross sections.

3. A system for weaving a three dimensional structure comprising:

a top perforated board for receiving planar yarns threaded therethrough;

a bottom structure consisting of two crossed reeds, the density of the two crossed reeds being determined by a required density of the three dimensional structure, the two crossed reeds being separable for threading;

four shaped reeds enclosing a working section of a warp, each shaped reed having an upper gauge equal to that of the perforated board, and a lower gauge equal to that of the crossed reed;

four moving rods for first reducing the density of a weft sheet by moving weft yarns against the shaped reed and then for compressing the weft yarns against the three dimensional woven structure.

* * * * *